US005947108A

United States Patent [19]

Ban et al.

[11] Patent Number: 5,947,108

[45] Date of Patent: Sep. 7, 1999

[54] VISCOUS FLUID HEATER

[75] Inventors: Takashi Ban; Tatsuyuki Hoshino; Takahiro Moroi; Kiyoshi Yagi, all of Kariya, Japan

[73] Assignee: Kabushiki Kaisha Toyoda Jidoshokki Seisakusho, Kariya, Aichi-ken, Japan

[21] Appl. No.: 08/900,741

[22] Filed: Jul. 25, 1997

[30] Foreign Application Priority Data

Jul. 26, 1996 [JP] Japan ..... 8-197708

[51] Int. Cl.[6] ..... F24C 9/00

[52] U.S. Cl. ..... 126/247; 122/26; 237/12.3 B

[58] Field of Search ..... 126/247; 122/26; 237/12.3 B

[56] References Cited

U.S. PATENT DOCUMENTS 3,791,167 2/1974 Eskeli ..... 126/247

4,004,553 1/1977 Stenstrom ..... 126/247

4,454,861 6/1984 Grenier ..... 122/26

*Primary Examiner*—Carroll B. Dority

*Attorney, Agent, or Firm*—Morgan & Finnegan, L.L.P.

[57] ABSTRACT

An improved viscous heater is disclosed. The viscous heater has a heating chamber accommodating viscous fluid and a rotor. The rotor rotates to shear and heat the viscous fluid. The heating chamber has a pair of inner flat surfaces and an inner peripheral surface. The rotor has a pair of outer flat surfaces that respectively opposes the inner flat surfaces by predetermined gaps and an outer peripheral surface that opposes the inner peripheral surface. The outer peripheral surface has peripheral edge portions each angularly and continuously extending from the outer flat surface. The peripheral edge is chamfered so that the rotor is prevented from interfering with the inner flat surfaces.

22 Claims, 5 Drawing Sheets

VISCOUS FLUID HEATER

BACKGROUND OF THE INVENTION

1. Field of the Invention

The present invention relates to a viscous fluid heater provided with a housing, which accommodates a heating chamber and a heat exchanging chamber, and a rotor that shears viscous fluid contained in the heating chamber to generate beat and exchange heat with circulating fluid contained in the heat exchanging chamber.

2. Description of the Related Art

Viscous fluid heaters, which are operated by the drive fore of automobile engines, have become widely used as an auxiliary heat source for automobiles. Japanese Unexamined Patent Publication No. 2-246823 describes a typical viscous fluid heater. The heater has front and rear housings that are fastened together by bolts, The coupled housings accommodate a heating chamber and a water jacket. Circulating coolant is drawn into the water jacket from an external heater circuit through an inlet port. The coolant in the water jacket is returned to the heater circuit through an outlet port. A drive shaft is rotatably supported in the front housing by bearings. A rotor, which rotates in the heating chamber, is fixed to the drive shaft. The walls of the heating chamber are provided near the rotor. Labyrinth grooves are defined in the walls of the heating chamber and in the outer surface of the rotor. The space between the heating chamber walls and the outer surface of the rotor is filled is viscous fluid such as silicone oil.

When the drive shaft is driven by the engine, the rotor rotates inside the heating chamber. The rotation of the rotor agitates and shears the viscous fluid located between the heating chamber walls and the rotor surface. This heats the viscous fluid. The heated viscous fluid exchanges heat with the coolant circulating through the water jacket. The heated coolant is then sent to the heater circuit to warm the passenger compartment.

In this prior art heater, there is a tendency for the rotor surface and the heating chamber wall to interfere with each other when increasing the heat generated during each rotation of the rotor.

In this type of heater, a belt transmits the drive force of the engine to the drive shaft by means of an electromagnetic clutch pulley or a pulley directly coupled to the drive shaft. Thus, when tension is applied to the belt due to changes in the engine speed or for other reasons, the tension is transmitted to the pulley. This inclines the axis of the drive shaft with respect to the ideal rotating axis and rotates the drive shaft in an inclined state. Furthermore, the perpendicularity between the drive shaft and the rotor, the parallelism between the rotor surface and the heating chamber wall, and the axial dimension of the heating chamber are not perfectly accurate. This is because of the dimensional margins that are allowed during production.

The rotor rotates and shears the viscous fluid most effectively when the dimension of the gap between the heating chamber wall and the rotor surface is one millimeter or less. Therefore, when the rotor rotates in an inclined state with respect to the heating chamber, interference occurs between the rotor surface and the heating chamber walls. This causes abrasion of the rotor surface and the chamber walls. To avoid such interference, the gap between the rotor surface and the heating chamber may be enlarged. However, this degrades the shearing effect of the rotor and decreases the heat generated during each rotation of the rotor.

SUMMARY OF THE INVENTION

Accordingly, it is an objective of the present invention to provide a viscous fluid heater that avoids interference between the rotor surface and the heating chamber walls and thus prevents abrasion of the rotor and the heating chamber while ensuring the generation of a large amount of heat.

To achieve the above objective, an improved viscous heater is disclosed. The viscous heater has a heating chamber accommodating viscous fluid and a rotor. The rotor rotates to shear and heat the viscous fluid. The heating chamber has a pair of inner flat surfaces and an inner peripheral surface. The rotor has a pair of outer flat surfaces that respectively opposes the inner flat surfaces by predetermined gaps and an outer peripheral surface that opposes the inner peripheral surface. The outer peripheral surface has peripheral edge portions each angularly and continuously extending from the outer flat surface. The peripheral edge is chamfered so that the rotor is prevented from interfering with the inner flat surfaces.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 5(*b*) is a cross-sectional view showing a another form of the rotor;

DETAILED DESCRIPTION OF THE PREFERRED EMBODIMENTS

A first embodiment of a viscous fluid heater incorporated in a heater for an automobile according to the present invention will now be described with reference to FIGS. 1 to 4.

Figure 1:
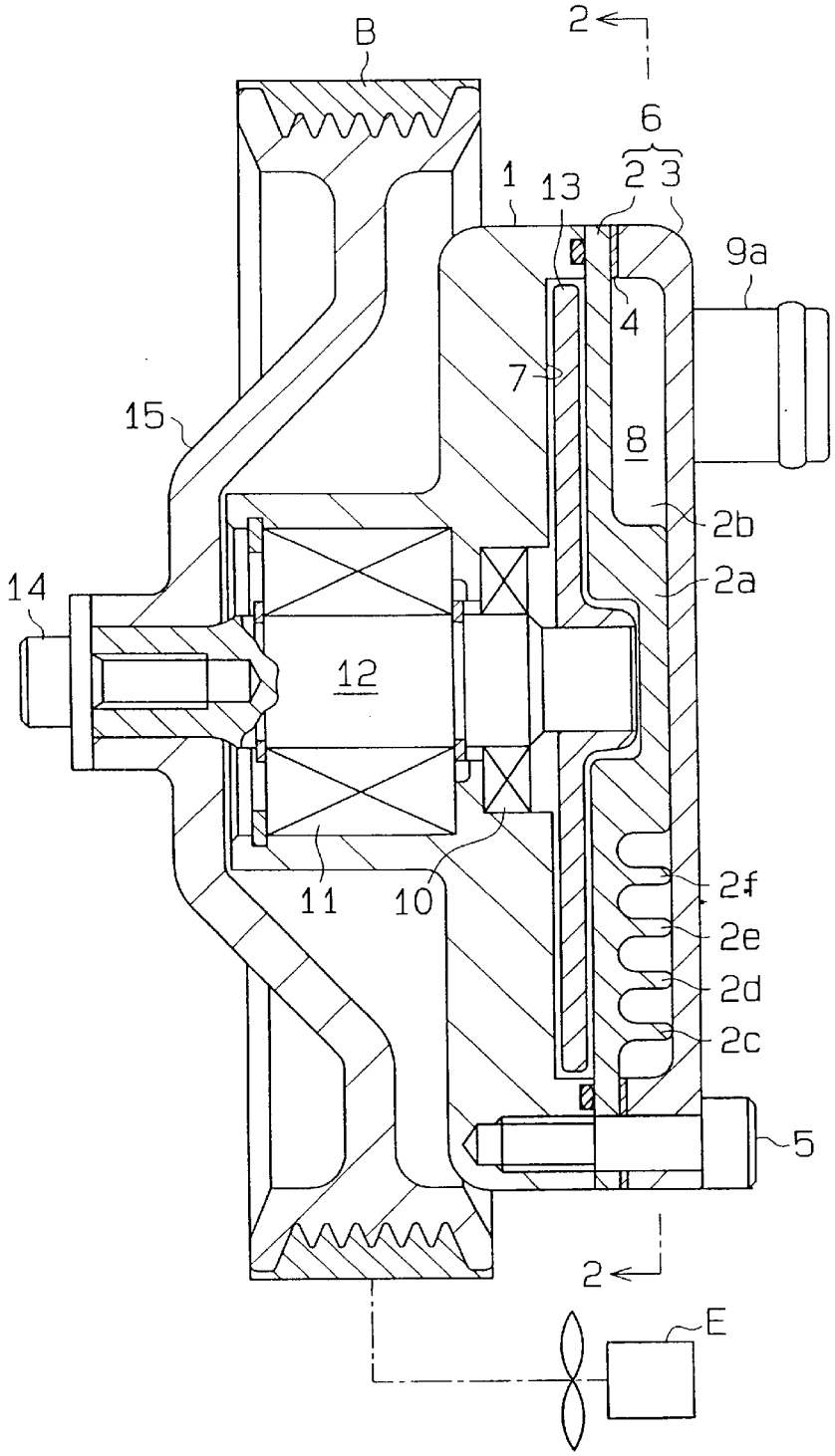
FIG. 1 is a cross-sectional view taken along line 1—1 in FIG. 2 and showing a first embodiment according to the present invention.

As shown in FIG. 1, a plurality of bolts 5 (only one is shown) fasten together a front housing 1, a partitioning plate 2, and a rear housing body 3 with a gasket 4 arranged between the partitioning plate 2 and the rear housing body 3. A rear housing 6 is constituted by the partitioning plate 2 and the rear housing body 3.

A recess is provided in the rear side of the front housing 1. A heating chamber 7 is defined between the flat front surface of the partitioning plate 2 and the walls of the recess. In other words, the heating chamber 7 is defined between the peripheral wall, the flat front wall, and the flat rear wall. A water jacket 8 serving as a heat exchanging chamber is provided adjacent to the heating chamber 7 between the rear surface of the partitioning plate 2 and the inner wall surf ace of the rear housing body 3. An inlet port 9*a* and an outlet port 9*b* are provided at the rear peripheral portion of the housing body 3. Circulating coolant is drawn into the water jacket 8 from a heating circuit (not shown) through the inlet port 9*a*. The coolant in the water jacket is returned to the heater circuit through the outlet port 9*b*.

Figure 2:
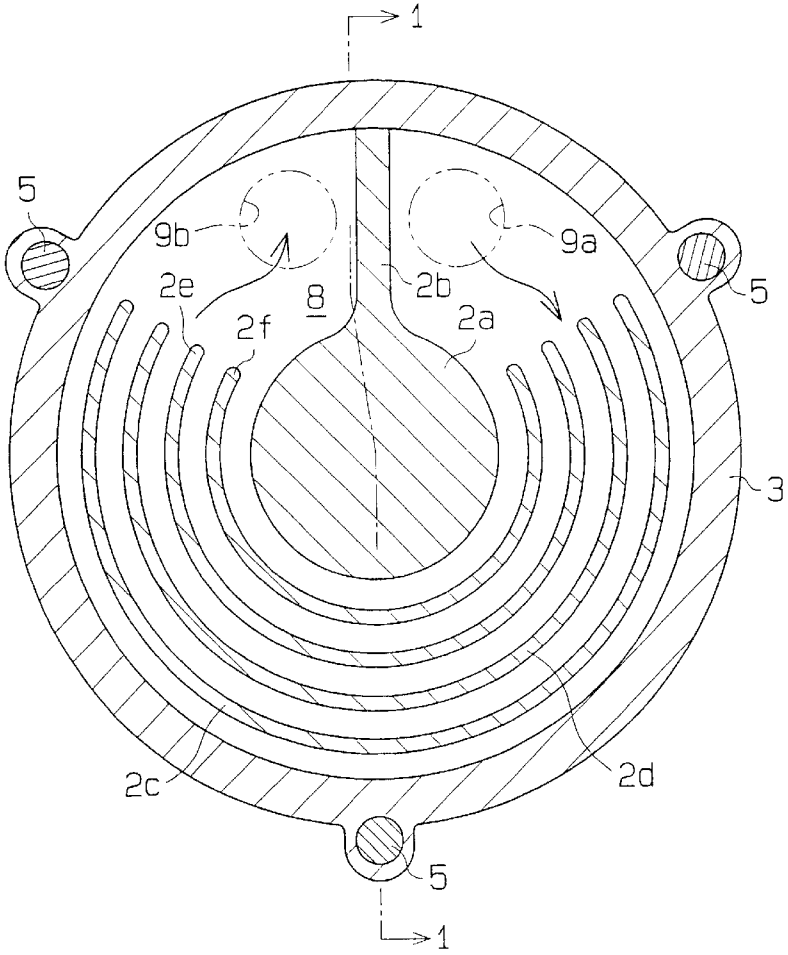
FIG. 2 is a cross-sectional view taken along line 2—2 in FIG. 1 with the pulley eliminated.

As shown in FIGS. 1 and 2, a cylindrical boss 2*a* and a partition 2*b* project from the rear surface of the partitioning plate 2. The boss 2*a* is located at the center of the plate 2. The partition 2*b* extends radially from the boss 2*a* toward the middle of the inlet port 9*a* and the outlet port 9*b*. A plurality of fins 2*c*, 2*d*, 2*e*, 2*f* are further provided at the rear side of the plate 2 extending in an arc-like manner about the boss 2*a* from the vicinity of the inlet port 9*a* to the vicinity of the outlet port 9*b*. The ends or the boss 2*a*, the partition 2*b*, and the fins 2*c*–2*f* abut against the inner wall of the rear housing body 3 and define passages for circulation of the coolant in the water jacket 8.

A seal 10 and a bearing 11 are arranged adjacent to the heating chamber 7 in the front housing 1. A drive shaft 12 is rotatably supported by the seal 10 and the bearing 11. An oil seal is preferably used as the seal 10. A disk-like rotor 13, which is accommodated in the heating chamber 7, is press fitted to the distal end (to the right as viewed in FIG. 1) of the drive shaft 12 so that the rotor 13 and shaft 12 rotate integrally. Viscous fluid such as silicone oil is contained in the heating chamber 7, which accommodates the rear end of the drive shaft 12 and the rotor 13. Surface tension of the silicone oil enables the silicone oil to occupy the space between the wall of the heating chamber 7 and the surface of the rotor 13.

A pulley 15 is fastened to the front end (to the left as viewed in FIG. 1) of the drive shaft 12 by a bolt 14. A belt B connects the pulley 15 to a vehicle engine E. Thus, the drive force of the engine E rotates the drive shaft 12 by means or the pulley 15. This rotates the rotor 13 integrally. The rotation of the rotor 13 shears and heats the silicone oil in the gap between the heating chamber wall and the rotor surface. The heated silicone oil exchanges heat with the coolant, which serves as a circulating fluid, in the water jacket 8. The heated coolant is then sent to a heater circuit (not shown) to heat the passenger compartment.

Figure 3C:
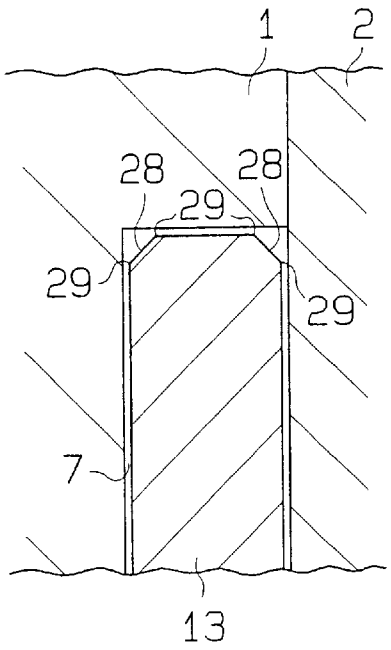
FIGS. 3(*a*), 3(*b*), 3(*c*) are partial cross-sectional views showing different forms of the edge of the rotor.
Figure 3B:
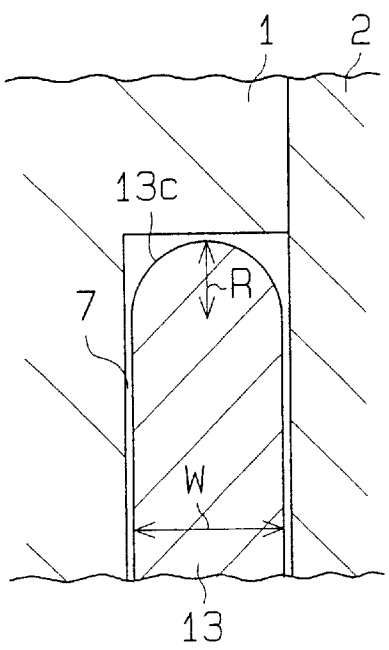
Figure 3A:
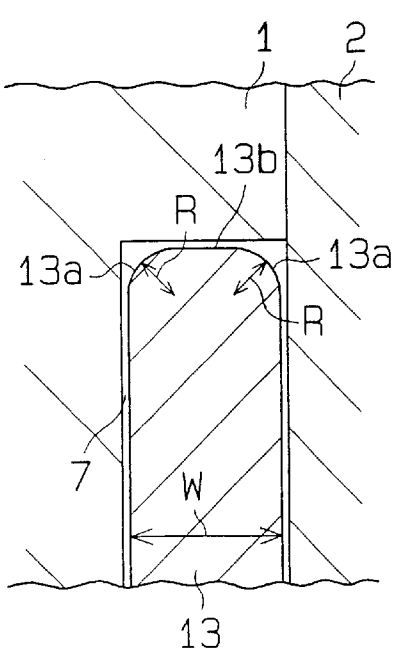

A large portion or the front and rear surfaces of the rotor 13 and the peripheral surface of the rotor 13 is formed parallel to the opposing wall of the heating chamber 7. Furthermore, the corners at the front and rear peripheral edges of the rotor 13 are removed. In other words, as shown in FIG. 3(*a*), the peripheral edge of the rotor 13 has a pair of rounded corners 13*a* and a cylindrical portion 13*b* extending between the rounded corners 13*a*. The rounded corners 13*a* are provided at the front and rear edges of the rotor 13. Therefore, at the corners 13*a*, the rotor 13 is separated from the walls of the heating chamber 7. It is preferable that the radius of curvature R of each rounded corner 13*a* be about one fourth the thickness W of the rotor 13.

Instead of including the cylindrical portion 13*b* on the peripheral edge, a convex edge 13*c* may be provided along the entire circumference of the rotor 13, an shown in FIG. 3(*b*). In this case, it is preferable that the radius of curvature R of the convex edge 13*c* be one half the thickness W of the rotor 13.

Although the sharp corners of the rotor edge are removed, the convex rounded corners 13*a* provided on each side of the cylindrical portion 13*b* prevent a drastic decrease of the area occupied by the rotor 13 in the narrow gap between the rotor 13 and the walls of the heating chamber 7. Furthermore, when there are two rounded corners 13*a*, the area of the rotor 13 is greater than when providing only one rounded portion (convex edge 13*c*) that extends along the entire peripheral portion. Therefore, the cylindrical portion 13*b* contributes to the generation of heat when shearing the viscous fluid.

Furthermore, as shown in FIG. 3(*c*), the corners of the rotor 13 may be removed so as to form a beveled portion 28. In this case, intersections 29 of the beveled portion 28 and the surfaces of the rotor 13 are formed at obtuse angles. This structure provides four corners (the intersections 29) formed at obtuse angles between the beveled surfaces and the other surfaces of the rotor 13. The obtuse corners enhance the shearing effect of the rotor and improve the heating efficiency in comparison to a rotor having rounded corners or a rounded edge.

The tension of the belt B wound about the pulley 15 may cause the drive shaft 12 to rotate in an inclined state (a state in which the axis of the rotor 13 is inclined with respect to the ideal rotating axis). The parallelism between the rotor 13 and the walls of the heating chamber 7, and the axial position of the rotor 13 cannot be perfectly accurate due to dimensional margins that are allowed during production. Thus, if the front and rear surfaces of the rotor 13 intersect the peripheral surface of the rotor 13 at right angles and form corners at the rotor edges as in the prior art, the edges of the rotor 13 may interfere, or contact, the wall of the heating chamber 7, especially when the radius of the rotor 13 is large. Rotation of the rotor 13 in an inclined state causes abrasion of the contacting surfaces. Furthermore, this may apply additional load to the engine E and increase fuel consumption.

However, in this embodiment, the corners at the front and rear edges of the rotor 13 are removed. This prevents the peripheral edges of the rotor 13 from interfering, or contacting, the wall of the heating chamber 7 when the rotor 13 rotates in an inclined state. (Abrasion of the rotor 13 and the wall of the heating chamber 7 is decreased even it the rotor 13 is greatly inclined.) As a result, abrasion of the contacting surfaces of the rotor 13 and the heating chamber 7 is prevented. In addition, the rotor 13 does not apply additional load to the engine B. This prevents increases in fuel consumption. Although a longer cylindrical portion 13*b* would increase the heating efficiency, this increases the possibility of interference with the heating chamber 7. Thus, as shown in FIG. 3(*a*), it is preferable that the radius of curvature of the rounded corner 13*a* be about one fourth of the thickness of the rotor 13 when rounding the corners.

As described above, the corners at the edge of the rotor 13 are removed. This avoids interference, or contact, between the surface of the rotor 13 and the walls of the heating chamber 7 even if the rotor 13 rotates in an inclined state. Thus, abrasion of the contacting surfaced of the rotor 13 and heating char 7 is avoided. In addition, since interference is avoided, the rotor 13 does not apply additional load to the engine E. This prevents increase in fuel consumption.

Since the rotor 13 is disc-like, a large amount of heat is generated at the front and rear faces of the rotor 13. Although the diameter of the rotor 13 is long, the large heating area of the faces enables the axial length of the rotor 13 to be shortened. Thus, a long space in the axial direction need not be provided for accommodating the rotor 13.

The rotor 13 is fixed to the drive shaft 12 by press fitting the rotor 13 to the shaft 12. In comparison with when employing a spline joint to fix the rotor 13 to the drive shaft 12, the inclination of the rotor 13 with respect to the drive shaft 12 is minimized. Furthermore, the press fitting of the rotor 13 facilitates the manufacturing of the viscous fluid heater.

Figure 4:
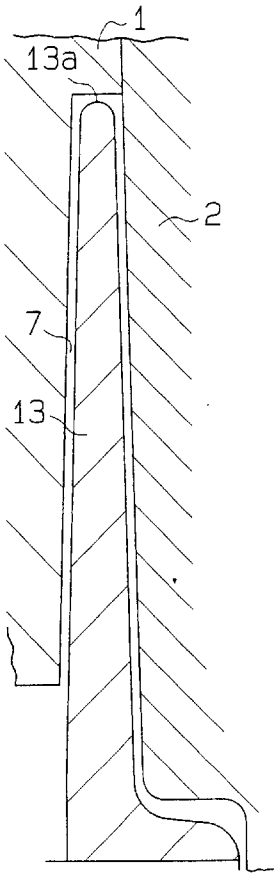
FIG. 4 is an enlarged partial cross-sectional view showing a different form of the rotor of the first embodiment.

The disc-like rotor 13 need not have a uniform thickness. For example, as shown in FIG. 4, the rotor 13 may be tapered so that the rotor 13 becomes thinner toward the periphery as long as sufficient strength is guaranteed. When the diameter of the rotor 13 is increased to increase the heating area of the rotor 13, the center portion of the rotor 13, which receives the greatest load, must have a certain thickness to ensure strength. In comparison with the use of a rotor having a uniform thickness, a tapered rotor having a predetermined thickness at its center portion reduces the total volume of the rotor material and decreases the power consumed when rotating the rotor.

A further embodiment according to the present invention will now be described with reference to FIGS. 5(*a*), 5(*b*), and 6. In this embodiment, the disc-like rotor is replaced with a cylindrical rotor. To avoid a redundant description, like or same numerals are given to those components that are like or the same as the corresponding components of the first embodiment.

Figure 5A:
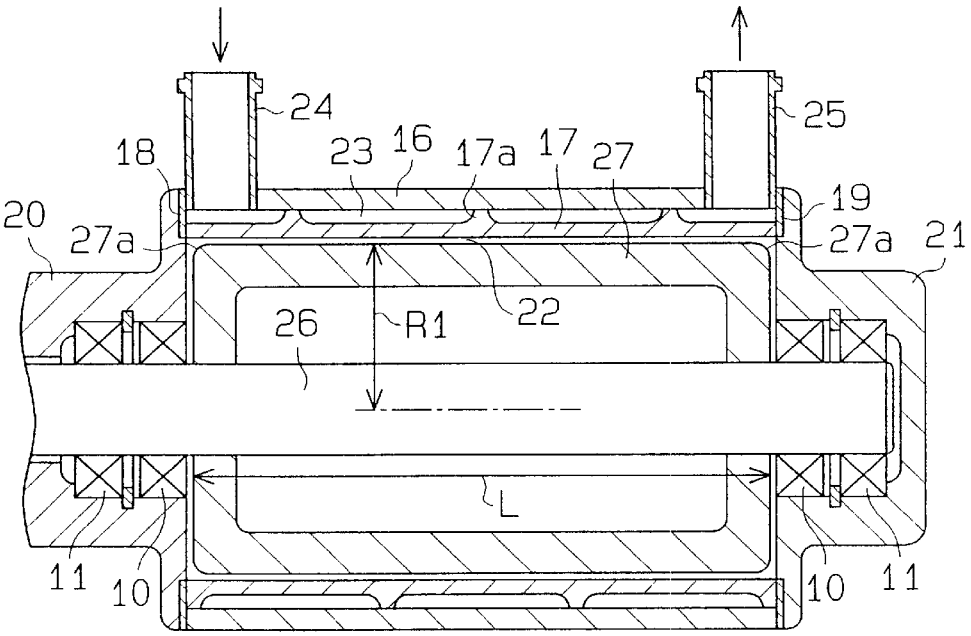
FIG. 5(*a*) is a cross-sectional view showing a further embodiment according to the present invention.
Figure 5B:
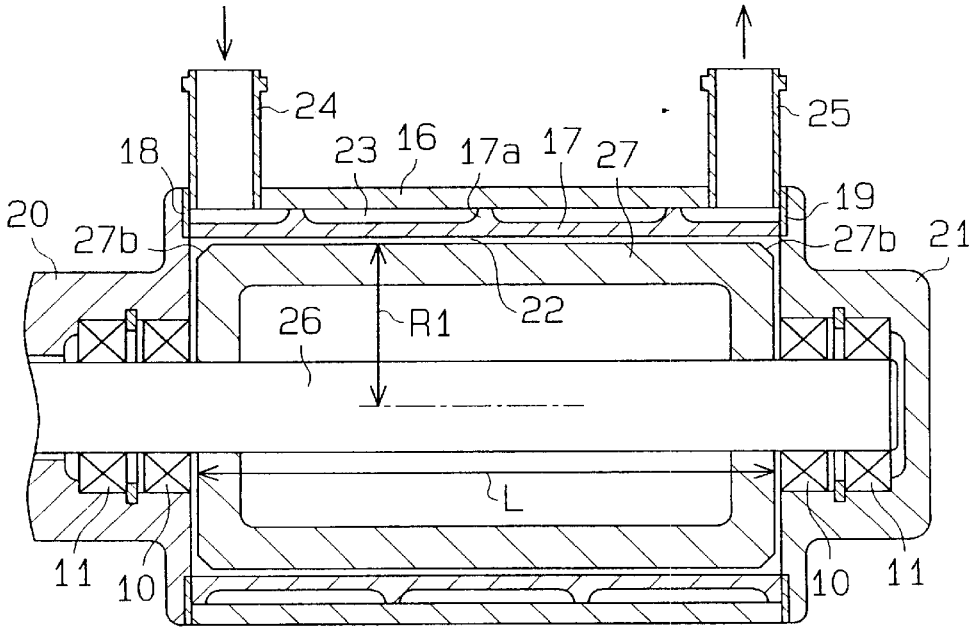

As shown in FIG. 5(*a*), a tubular cylinder block 17 is pressed into a cylindrical intermediate housing 16. A front housing 20 is coupled to the front ends of the intermediate housing 16 and the cylinder block 17 with a gasket 18 arranged therebetween. A rear housing 21 is coupled to the rear ends of the intermediate housing 16 and the cylinder block 17 with a gasket 19 arranged therebetween. A heating chamber 22 is defined in the cylinder block 17. A helical rib 17*a* extends along the outer surface of the cylinder block 17. The helical rib 17*a* abuts against the inner surface of the intermediate housing 16. Thus, a helical water jacket 23, which serves as a heat exchanging chamber, is defined adjacent to the heating chamber 22 between the inner surface of the intermediate housing 16 and the outer surface of the cylinder block 17.

An inlet port 24 projects from the front part of the intermediate housing 16 while an outlet port 25 projects from the rear part of the intermediate housing 16. The ports 24, 25 are communicated with the water jacket 23. Circulating coolant is drawn into the water jacket 23 from an external heater circuit (not shown) through the inlet port 24. The coolant in the water jacket 23 is returned to the heater circuit though the outlet port 25.

Seals 10 and bearings 11 are arranged in the front and rear housings 20, 21 to rotatably support a drive shaft 26. A rotor 27 is pressed onto the drive shaft 26 so as to rotate integrally with the shaft 27 in the heating chamber 22. The rotor 27 is hollow and made of aluminum alloy. The radius R1 of the rotor 27 is shorter than the axial length L of the rotor 27.

Silicone oil serving as a viscous fluid is charged into the heating chamber 22, which accommodates the rear end of the drive shaft 26 and the rotor 27. Thus, silicone oil occupies the gap between the walls of the heating chamber 22 and the outer surface of the rotor 27. If silicone oil occupied the entire volume of the space between the walls of the heating chamber 22 and the outer surface of the rotor 27, the silicone oil might leak out when expanded by heat. To prevent such leakage, gas (e.g., air) also occupies the space.

Rounded corners 27*a* are provided on the ends of the rotor 27. When representing the length of the rotor 27 with L, the radius of curvature R of the rounded corners 27*a* is preferably determined so that 2R in five percent or less of L.

The rotation of the rotor 27 heats the silicone oil. Since the sharp corners of the rotor 27 are removed, interference (contact) between the edges and the inner walls of the heating chamber 22 is avoided even if the rotor 27 rotates in an inclined state. This prevents abrasion of the contacting surfaces of the rotor 27 and the heating chamber 22. Furthermore, wince interference is avoided, the rotor 27 does not apply additional load to the engine E. This prevents an increase in fuel consumption. If the radius of curvature R of the rounded corners 27*a* is large, the gap between the walls of the heating chamber 22 and the rounded corners 27*a* becomes large. This degrades the heating efficiency. Thus, it is preferable that the radius of curvature R be maintained at 2.5 percent or less or the length of the rotor 27. However, if the radius of curvature R becomes too small, the possibility of the rotor 27 interfering with the walls of the heating chamber 7 becomes too high.

In the viscous fluid heater of this embodiment, a large amount of heat is generated at the peripheral surface of the rotor 27. Although the length of the rotor 27 is long in this embodiment, the diameter of the rotor 27 is relatively short. Therefore, the viscous fluid heater may be installed in a space, the width and height of which are small, as long as the length of the space is long. Furthermore, the hollow structure of the rotor 27 in this embodiment decreases the power required for rotating the rotor 27.

As shown in FIG. 5(*b*), the rounded corners 27*a* of the cylindrical rotor 27 may be replaced by beveled portions 27*b*. This structure further enhances the shearing effect of the viscous fluid in the heating chamber 22.

Figure 6:
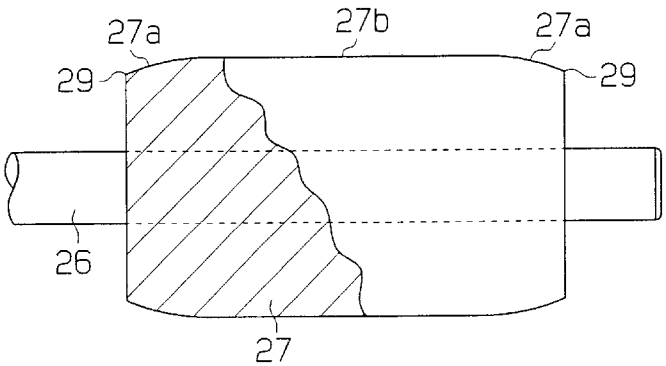
FIG. 6 is a partial cross-sectional view showing a rotor of a further embodiment.

When forming convex rounded corners at the edges of the rotor, the rounded corners need not be circular. Each rounded corner may be formed so that the shape of its profile corresponds to a parabola or a curve of a higher order. Furthermore, the edges of the rotor 27 may be formed so that the ends of the rotor 27 are tapered, as shown in FIG. 6. Furthermore, the rotor 27 need not be hollow, and may be a solid body.

Although several embodiments of the present invention have been described so far, it should be apparent to those skilled in the art that the present invention may be embodied in many other specific forms without departing from the spirit or scope of the invention. More particularly, the present invention may be embodied in the modes described below.

(1) Instead of pressing the rotor 13 onto the rear end of the drive shaft 12, the rotor 13 may be fit to the drive shaft 12 by employing a spline joint that restricts relative rotation and permits axial displacement. This enables smooth movement of the silicone oil between the edges of the rotor 13 and the walls of the heating chamber 7. As a result, the rotor 13 is easily hold at a neutral position in the heating chamber 7 due to the uniform pressure at the front and rear sides of the rotor 13.

(2) The corners at both the front and rear of the rotor do not necessarily have to be removed. Thus, one corner may be removed while the other corner is not removed. Forces tend to urge the rotors 13, 27 toward the rear (especially when using an electromagnetic clutch). Thus, when using the disc-like rotor 13, the diameter of which in large, or when using spline joints to couple the rotor 13 to the drive shaft, the rear and of the rotor in particular tends to interfere with the wall of the heating chamber. Thus, it is preferable that at least the corner at the rear side of the rotor be removed.

(3) An electromagnetic clutch may be installed between the pulley 15 and the drive shafts 12, 26 to selectively transmit the drive force of the engine E to the drive shafts 12, 26.

Viscous fluid is not limited to semifluids or liquids having high viscosity such as silicone oil but includes any type of medium that generates heat when sheared by the rotor.

The walls of the heating chamber need not entirely correspond with the surface of the rotor. The walls may be spaced apart from the rotor at regions that do not necessarily have to receive the shearing effect.

Therefore, the present examples and embodiments are to be considered as illustrative and not restrictive and the invention is not to be limited to the details given herein, but may be modified within the scope of the appended claims.

What is claimed is:

1. A viscous heater comprising:

a front housing;

a rear housing coupled to the front housing;

a plate located between the front housing and the rear housing;

a heating chamber defined by the front housing and the plate for accommodating viscous fluid, the heating chamber having a pair of inner flat surfaces and an inner peripheral surface;

a rotor located in the heating chamber for generating heat by shearing the viscous fluid upon rotation of the rotor, the rotor comprising:

a pair of outer flat surfaces, each outer flat surface opposing a respective inner flat surface of the heating chamber and being spaced from each inner flat surface by respective predetermined gaps;

an outer peripheral surface opposing the inner peripheral surface of the heating chamber; and a chamfered surface between and adjoining the outer flat surface closest to the plate to the outer peripheral surface.

2. The viscous heater as set forth in claim 1, wherein the chamfered surface is beveled surface which in a cross-sectional view, forms obtuse angles with the adjoining outer flat surface and the outer peripheral surface, respectively.

3. The viscous heater as set forth in claim 1, further comprising a water jacket defined by the rear housing and the plate, the water jacket being adjacent to the heating chamber, for the transfer of heat generated in the heating chamber.

4. The viscous heater as set forth in claim 1, comprising first and second chamfered surfaces between each of the outer flat surfaces and the outer peripheral surface, respectively.

5. The viscous heater as set forth in claim 4, wherein the chamfered surfaces are rounded, the outer peripheral surface comprises a cylindrical surface between the rounded chamfered surfaces and the radius of curvature of each rounded surface is about one-fourth of the thickness of the rotor.

6. The viscous heater as set forth in claim 1, wherein the rotor has a thickness which decreases towards the outer peripheral surface of the rotor.

7. A viscous heater comprising:

a first housing;

a second housing coupled to the first housing;

a plate located between the first housing and the second housing;

a heating chamber defined by the first housing and the plate for accommodating viscous fluid, the heating chamber having a pair of inner flat surfaces and an inner peripheral surface;

a rotor located in the heating chamber for generating heat by shearing the viscous fluid upon rotation of the rotor, the rotor comprising:

a pair of outer flat surfaces, each outer flat surface opposing a respective inner flat surface of the heating chamber and being spaced from each inner flat surface by respective predetermined gaps;

an outer peripheral surface opposing the inner peripheral surface of the heating chamber; and a chamfered surface between and adjoining at least one of the outer flat surfaces and the outer peripheral surface.

8. A viscous heater comprising:

a heating chamber for accommodating viscous fluid, the heating chamber having a pair of inner flat surfaces and an inner peripheral surface;

means forming a heat exchange chamber for the transfer of heat from the heating chamber to a fluid circulating through the heat exchange chamber, the heat exchange chamber being adjacent to the heating chamber;

a rotor located in the heating chamber for generating heat by shearing the viscous fluid upon rotation of the rotor, the rotor comprising:

a pair of outer flat surfaces, each of which opposes a respective inner flat surface of the heating chamber and is spaced from the opposing inner flat surface by respective predetermined gaps;

an outer peripheral surface opposing the inner peripheral surface of the heating chamber; and a chamfered surface formed between and adjoining at least one of the outer flat surfaces and the outer peripheral surface.

9. The viscous heater as set forth in claim 8, wherein the chamfered surface is a beveled surface which in a cross-sectional view, forms obtuse angles with the adjoining outer flat surface and the outer peripheral surface, respectively.

10. The viscous heater as set forth in claim 8, wherein the rotor is disk-shaped.

11. The viscous heater as set forth in claim 10, comprising a first and a second chamfered surface formed between each of the outer flat surfaces and the outer peripheral surface, respectively, the chamfered surfaces being rounded, wherein the outer peripheral surface comprises a cylindrical surface between the rounded chamfered surfaces and the radius of curvature of each chamfered surface is about one-fourth of the thickness of the rotor.

12. The viscous heater as set forth in claim 8, wherein the axial length of the rotor is greater than the radius of the rotor.

13. The viscous heater as set forth in claim 12, comprising a first and a second chamfered surface formed between each of the outer flat surfaces and the outer peripheral surface, respectively.

14. The viscous heater as set forth in claim 10, wherein the rotor has a thickness which decreases towards the outer peripheral surface of the rotor.

15. A viscous heater comprising:

a heating chamber for accommodating viscous fluid, the heating chamber including a pair of opposed flat walls spaced apart by a predetermined distance, and a peripheral cylindrical wall, wherein the peripheral cylindrical wall is located between the opposed flat walls; and a cylindrical rotor located in the heating chamber for shearing and heating the viscous fluid upon rotation about the axis, the rotor having a pair of opposite, parallel, flat surfaces, a cylindrical edge surface and a chamfered surface between and adjoining at least one of the flat surfaces and the cylindrical edge surface;

wherein each of the flat surfaces of the rotor face axially toward an opposite flat wall of the heating chamber, respectively, and the cylindrical edge surface of the rotor faces radially toward the peripheral cylindrical wall, gaps of a predetermined distance, as measured in the axial direction, are formed between the flat surfaces of the rotor and the flat walls of the heating chamber, respectively, and a gap of a predetermined distance, as measured in the radial direction, is formed between the cylindrical edge surface of the rotor and the peripheral cylindrical wall of the heating chamber.

16. The viscous heater as set forth in claim 15, wherein the axial length of the rotor is greater than the radius of the rotor.

17. The viscous heater as set forth in claim 15, wherein the chamfered surface is a beveled surface which in a cross-sectional view, forms obtuse angles with the adjoining flat surface and the cylindrical surface, respectively.

18. The viscous heater as set forth in claim 15, comprising first and second chamfered surfaces between the cylindrical edge surface and each of the flat surfaces, respectively.

19. The viscous heater as set forth in claim 17, wherein the first and second chamfered surfaces are rounded.

20. The viscous heater as set forth in claim 15, further comprising means forming a heat exchange chamber adjacent to the heating chamber.

21. The viscous heater as set forth in claim 15, wherein the rotor comprises a hollow cylindrical body.

22. The viscous heater as set forth in claim 15, wherein each chamfered surface is connected to the cylindrical edge surface by a rounded corner and is connected to each of the outer flat surfaces by an angled corner.

* * * * *